United States Patent [19]

Smulders

[11] 4,160,881

[45] Jul. 10, 1979

[54] ELECTRET TRANSDUCERS: ACOUSTICALLY TRANSPARENT BACKPLATE OF SINTERED CONDUCTIVE SPHERES AND A THIN ELECTRET COATING; MESHLIKE DIAPHRAGM SPACING SCREEN OVERLAYS APERTURED ELECTRET BACKPLATE WITH SCREEN JUNCTIONS OVERLAYING THE APERTURES

[75] Inventor: Adrianus J. Smulders, Hoogland, Netherlands

[73] Assignee: Microtel B.V., Netherlands

[21] Appl. No.: 865,138

[22] Filed: Dec. 28, 1977

[51] Int. Cl.[2] ..... H04R 19/00

[52] U.S. Cl. ..... 179/111 E; 29/594

[58] Field of Search ..... 179/111 R, 111 E; 307/88 ET; 29/594

[56] References Cited

U.S. PATENT DOCUMENTS

| | | | |
|---|---|---|---|
| Re. 28,420 | 5/1975 | Murphy | 179/111 E |
| 2,192,653 | 3/1940 | Schenk | 179/111 R |
| 3,108,162 | 10/1963 | Schindler | 179/111 R |
| 3,740,496 | 6/1973 | Carlson et al. | 179/111 E |
| 3,783,202 | 1/1974 | Bobb | 179/111 R |

FOREIGN PATENT DOCUMENTS

| | | | |
|---|---|---|---|
| 348573 | 5/1931 | United Kingdom | 179/111 E |
| 1219561 | 1/1971 | United Kingdom | 179/111 R |

*Primary Examiner*—George G. Stellar

*Attorney, Agent, or Firm*—Brady, O'Boyle & Gates

[57] ABSTRACT

A motor assembly for an electret transducer, wherein spacing means supporting the diaphragm plate on the backplate are manufactured from a separate material which is applied on the backplate surface to achieve an accurately defined and reproduceable spacing therebetween. Such spacing means can be formed as a meshlike screen lying on the backplate surface. In an alternative embodiment wherein the backplate is constituted by substantially spherical, conductive particles sintered together, the spacing means are formed by an acoustical porous coating applied on the backplate surface, which coating also acts as an electret.

7 Claims, 6 Drawing Figures

ELECTRET TRANSDUCERS: ACOUSTICALLY TRANSPARENT BACKPLATE OF SINTERED CONDUCTIVE SPHERES AND A THIN ELECTRET COATING; MESHLIKE DIAPHRAGM SPACING SCREEN OVERLAYS APERTURED ELECTRET BACKPLATE WITH SCREEN JUNCTIONS OVERLAYING THE APERTURES

BACKGROUND OF THE INVENTION

1. Field of the Invention

The invention relates to a motor assembly for an electret transducer comprising a diaphragm plate and a backplate with spacing means between the diaphragm plate and the backplate for supporting the diaphragm plate on the backplate.

2. Prior Art

In the prior art, for instance as disclosed in U.S. Pat. No. 3,740,496, titled "Diaphragm Assembly for Electret Transducer", the central vibratable diaphragm plate and the backplate have protrusions or posts therebetween on which the diaphragm plate rests to thereby properly position the diaphragm plate relative to the electret which is mounted on the metal backplate. A practical difficulty arises in this prior art because the protrusions supporting the diaphragm plate are formed out of the backplate material by impressing a die on the opposite side thereof. With this technique it is a problem to form such protrusions within the stringent and close tolerances which are required to maintain and accurately reproduce the spacing between the diaphragm plate and the oppositely lying electret foil mounted on the backplate surface.

It is an object of the subject invention to provide a solution to the above problem. More in particular it is an object of the invention to provide a motor assembly for an electret transducer, which can be manufactured with a simple and economic process while meeting the stringent requirements imposed to the spacing between the diaphragm plate and backplate, and also having a high yield in a series of mass produced motor assemblies and transducers. It is a further object of the invention to improve the performance of an electret transducer thereby that the ratio between the total area of contact between the diaphragm plate and the diaphragm plate supporting protrusions and the freely movable area of the diaphragm plate is lowered compared to a similar ratio for a prior art structure.

Further it is an object of the invention to provide a method for manufacturing a motor assembly for an electret transducer and which method is appropriate for an economic production.

SUMMARY OF THE INVENTION

According to the invention a first embodiment of a motor assembly for an electret transducer comprises a diaphragm plate having a compliant surround at its periphery, a backplate having a meshlike screen lying on its surface, on which screen said diaphragm plate rests, wherein diaphragm plate portions supporting junctions of said screen are overlying holes formed through said backplate, and a mounting rim supporting said backplate and having a peripheral portion to which the outer edge portion of said diaphragm plate is attached.

An alternative embodiment of the invention of a motor assembly for an electret transducer comprises a composite backplate including a plate-like body constituted by substantially spherical, conductive particles sintered together and a thin acoustically porous coating of electret material disposed on the surface area of said body, a composite diaphragm plate constituted by an insulating layer and a conductive coating, said composite diaphragm plate with its insulating layer resting on said acoustically porous coating along a substantially flat plate substantially tangent to the contours of said plate-like body, and a mounting rim supporting said backplate and having a peripheral portion to which the outer edge portion of said composite diaphragm plate is attached.

DETAILED DESCRIPTION OF THE PREFERRED EMBODIMENTS

Figure 1:
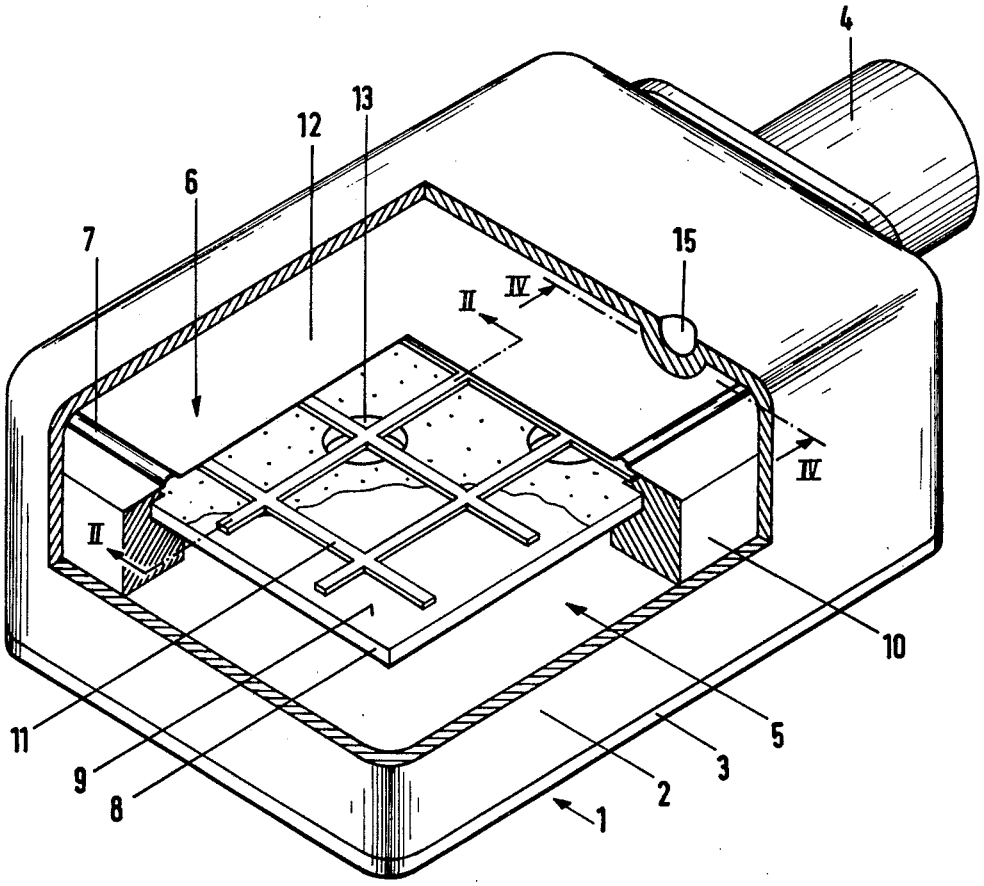
FIG. 1 shows a perspective view of an electret transducer having a first embodiment of a motor assembly in accordance with the invention incorporated therein, and wherein parts of the casing and diaphragm plate are removed.

FIG. 1 shows an electret transducer which in general is indicated by 1, wherein a first embodiment of a motor assembly in accordance with the invention has been incorporated.

The electret transducer comprises a casing 2, which in the embodiment shown is of an essentially rectangular shape. This box-like casing is attached to a baseplate 3. The casing is further provided with an outlet section 4. The motor assembly, which in general has been indicated by 5, which is fixed to the inner wall of casing 2, for instance by glueing, comprises a diaphragm plate 6 having a sight roll 7 at its periphery, a backplate 8 having an electret foil 9 on its surface opposite to said diaphragm plate, a mounting rim 10 which embraces the backplate along its periphery to support same, the outer edge portion of the diaphragm plate being attached to the rim surface portion overlying the backplate, and a spacing screen 11 which maintains an accurate spacing between the central vibratable plate portion 12 of said diaphragm plate 6 and the backplate 8.

The sidewall portion of said mounting rim 10 opposite the upstanding (as oriented in FIG. 1) sidewall of the casing 3 is acoustically sealed and afixed thereto so that between the lower surface (as oriented in FIG. 1) of the backplate and the baseplate 3 a first interior sound cavity has been formed. The backplate has one or more acoustical passages or holes 13 formed therethrough communicating with this first interior sound cavity which therefore is acoustically coupled to a second sound cavity between the central diaphragm plate portion 12 and the electret foil 9. By appropriately selecting the dimensions of the meshlike screen, such as for instance the mesh width dimension, the thickness and width of the posts forming the screen, the performance of the electret transducer elements defined by the separate meshes of the meshlike screen can be optimized. To provide the acoustical coupling between said first interior sound cavity and said second sound cavity, one or more junctions of the meshlike screen are overlying the acoustical passages such as 13 formed through the backplate.

The meshlike screen 11 can be readily and separately manufactured while maintaining close and stringent tolerances. Therefore the screen thickness which defines the spacing between the central diaphragm plate portion 12 and the electret foil 9 mounted on the backplate 8 is a design parameter which lends itself readily for an accurate and reproduceable manufacturing process. When having thus manufactured a separate spacing screen, such screen is mounted upon the electret foil 9 which is mounted on the backplate 8. By positioning the screen relative the apertures in the backplate in such a manner that one or more junctions of the meshlike screen are overlying the acoustical passages such as 13, the acoustical coupling between the first interior sound cavity formed between the lower backplate surface and the base plate 3 and the second sound cavity between the diaphragm plate portion 2 and the electret foil 9 is provided. The diaphragm plate 6 rests with its central vibratable portion 12 on the upper side of the screen which in its turn is supported by the electret foil 9 mounted on the backplate 8.

Figure 2:
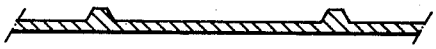
FIG. 2 is a cross-sectional view taken along the line II—II in FIG. 1 of a part of the meshlike screen.

FIG. 2 shows a first alternative embodiment of the meshlike screen 11. The junctions thereof are formed as protrusions having a frusto-conical form so that the smaller head surfaces of these protrusions form the spaced supports on which the central vibratable diaphragm plate portion 12 rests. In this manner the ratio between the total contact area between the central plate portion 12 and the protrusions on the one hand and the total freely vibratable area of said plate portion 12 on the other can be improved, i.e. reduced, which improves the signal-to-noise ratio and sensitivity characteristics. Such ratio can be further reduced with the further embodiment shown in FIG. 3. With that embodiment the junctions of the meshlike screen are formed as substantially half-spheres, whereby the central diaphragm plate portion 12 constitutes a tangent plane for said half-spherical protrusions.

The composite diaphragm 6 includes a diaphragm plate which may be made of polyethylene terephthalate or of any similar material. The central diaphragm plate portion 12 is coated on its lower (as oriented in FIG. 1) surface with a metallizing layer of conductive material, which, e.g., may be evaporated onto the surface.

The polarized dielectric film for electret 9, in one embodiment, is of polytetrafluoroethylene, or any other material having these characteristics. Such electret foil is mounted on the metal backplate 8.

Figure 3:
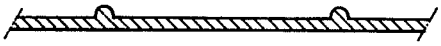
FIG. 3 shows a similar cross-sectional view of an alternative embodiment of such meshlike screen.

The principle underlying the embodiments shown in FIGS. 2 and 3 respectively obviously is also applicable to the basic screen structure as described in connection with the embodiment shown in FIG. 1. Therefore the upper surfaces (as oriented in FIG. 1) of the posts constituting the screen structure can be made smaller than the base surface thereof contacting the electret foil 9. In this manner the total area of the screen structure contacting the central diaphragm plate portion 12 can be minimized.

Figure 4:
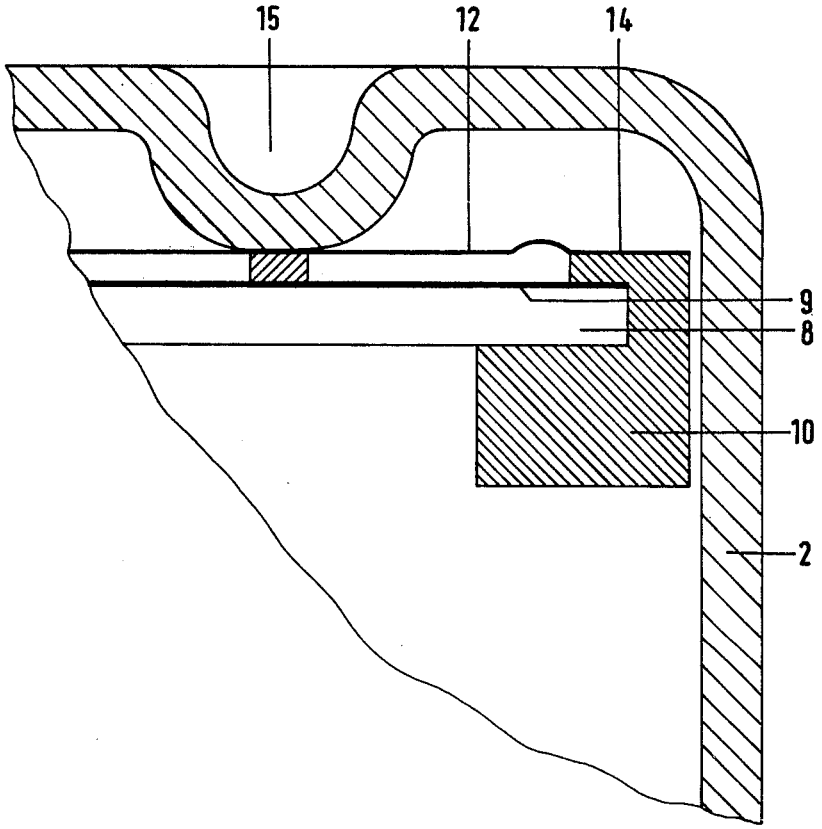
FIG. 4 shows a partially cross-sectional view taken along the line IV—IV in FIG. 1.

FIG. 4 in a partial cross-sectional view taken along lines IV—IV in FIG. 1 shows in greater detail the motor assembly structure and the manner in which such motor assembly has been mounted within the casing 3 of the transducer. The mounting rim 10 embraces the backplate 8 and the electret foil 9 mounted thereon along the peripheral edge. The diaphragm plate 6 with its outer edge portion 14 is afixed to the opposite surface portion of the mounting rim 10 so that at the periphery of the diaphragm plate a flexible and compliant surround is formed which assures that there is no appreciable tension in the diaphragm plate. Such connection between the upper surface (as oriented in FIG. 4) of the rim portion embracing the backplate electret foil assembly and the opposite edge portion 14 of the diaphragm plate 6 provides a compliant region whereby the effect of dimensional changes of the diaphragm relative to those of the backplate due to changes in temperature, humidity and aging of the materials themselves are minimized. In a preferred embodiment the insulating material of the mounting rim 10 is the same as that of the insulating layer included in the diaphragm plate 6. This facilitates the establishment of the connection between the corresponding portions of the mounting rim and diaphragm plate.

The casing in its upper wall (as oriented in FIG. 4) is provided with a plurality, preferably three, recessed portions 15 of which only one has been shown in FIG. 1. In the mounted condition the motor assembly by its upper surface (as oriented in FIG. 4) of the diaphragm plate portion 12 contacts the oppositely lying portions of the recesses 15 while the peripheral upstanding edge (as oriented in FIG. 4) of the mounting rim 10 is acoustically sealed to the corresponding inner wall portion of the casing 2. In this manner the aforementioned second sound cavity is formed.

Figure 5:
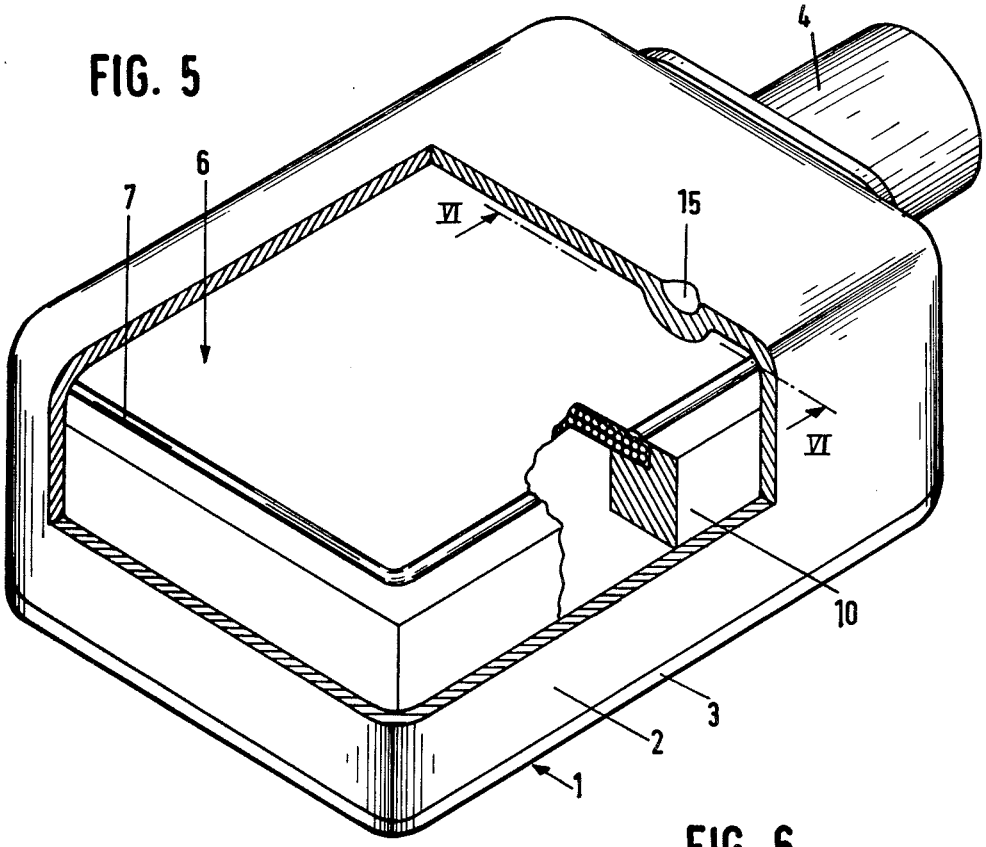
FIG. 5 shows a perspective view of an electret transducer having an alternative embodiment of a motor assembly in accordance with the invention incorporated therein, and wherein parts of the casing, diaphragm plate and mounting rim are removed.

FIG. 5 in a similar view as FIG. 1 shows an electret transducer having a second embodiment of a motor assembly in accordance with the invention incorporated therein.

Figure 6:
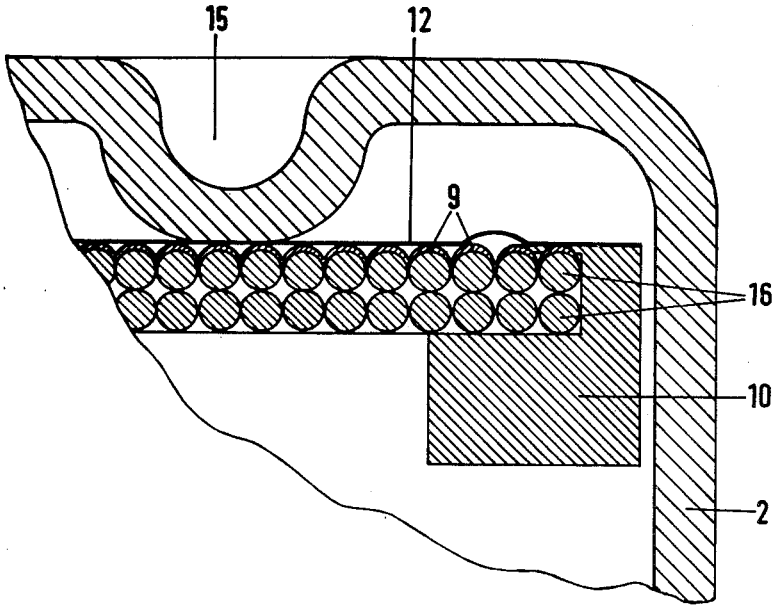
FIG. 6 shows a partial cross-sectional view taken along the line VI—VI in FIG. 5.

In FIGS. 5 and 6 components having a similar counter part in the foregoing embodiments have been indicated by the same reference numbers.

FIG. 6 shows in greater detail the structure of an alternative embodiment of the motor assembly and the manner in which such assembly has been mounted into the transducer casing.

In this alternative embodiment the motor assembly comprises a metal backplate constituted by substantially spherical, conductive particles such as 16, which are sintered together. Such a metal backplate has been coated with a thin layer of electret material 9, in such a manner that only the spherical particle surfaces are covered by the electret material. Such a backplate is acoustically transparent. The central diaphragm plate portion 12 rests on the protrusions formed by the electret material so that in this embodiment the electret material moreover acts as supporting protrusions on which the central diaphragm plate portion rests. In a similar way, as has been described in connection with FIG. 4, the diaphragm plate with its outer edge portion is attached to the upper surface portion (as oriented in FIG. 6) of the mounting rim portion overlying the peripheral edge of the backplate.

A motor assembly for an electret transducer in accordance with the invention by its structural arrangement makes it feasible to employ an economic and simple manufacturing process for manufacturing such motor assembly and transducer respectively. In a method for manufacturing a motor assembly for an electret transducer in accordance with the invention following steps are involved.

First a metal backplate, such as 8 in the embodiment shown in FIG. 1, is formed on which backplate then electret foil, such as 9, is mounted. The electret foil is subsequently electrically charged for instance by placing the backplate assembly into a uniform electric field. Following this charging step a meshlike spacing screen, such as 11 in the embodiment, shown in FIGS. 1 and 4, is disposed on the electret foil. Then the mounting rim made from an insulating material, such as a plastic material, is formed around the periphery of the composed backplate such that the mounting rim embraces the outer edge portion thereof. A sheet of diaphragm plate material is clamped into a support and the conductive coating is disposed thereon to define the central diaphragm plate portion, such as 12, in the embodiment shown in FIG. 1. Following this step the assembly comprising the composite backplate and spacing screen mounted thereon together with the embracing mounting rim is positioned onto the diaphragm plate sheet which is held in a substantially flat condition by the support, and in such a manner that the backplate side having the spacing screen thereon is oppositely lying the central diaphragm plate portion of the diaphragm plate sheet. Following this step the mounting rim surface portion, which is substantially co-planar relative to the plane of the spacing screen, is attached to the corresponding circumferential portion of the sheet of diaphragm plate material held in its support. In order to assure a perfect attachment between the mounting rim and the corresponding portion of the diaphragm plate, the assembly is heated to a temperature of about 95° C. while further on the opposite side of the diaphragm plate sheet, i.e. the side turned away from the side on which the assembly has been mounted, a suction force is applied so as to ensure that the tension in the central diaphragm plate portion is essentially zero. During this suction procedure at the periphery of the diaphragm plate a slight roll or corrugation is formed. The corresponding portions of the mounting rim and the diaphragm plate e.g. can be attached to each other by employing ultra-sound radiation. Having established such an attachment the finished motor assembly then can be removed from the support whereafter the motor assembly as a unit can be mounted into the casing of the transducer. This can be done by disposing the motor assembly into the casing, such as 2 of FIG. 1, which then is disposed with its open end turned upwardly so that the motor assembly with its diaphragm plate can be mounted on the recessed portions formed in the "bottom wall" of the casing. In this position the motor assembly then can be attached to the inner wall portion of the casing, e.g. by glueing the outer peripheral edge portion of the mounting rim to the oppositely lying inner wall portion of the casing.

For the manufacturing of a motor assembly as described in the foregoing with reference to FIGS. 5 and 6 firstly a conductive backplate is formed from substantially spherical conductive particles each having an external diameter of an order of magnitude of 0.1 mm and which particles are sintered together. Having thus formed a conductive and acoustically transparent backplate of appropriate dimensions, such backplate then is covered by a coating of electret material. This coating process can for instance be executed by spraying the electret material onto the backplate surface with an appropriately high pressure so that the backplate is covered with an acoustical transparent coating of electret material. The electret coating thus provided at one side of the conductive backplate serves a dual purpose, i.e. as an electret and as diaphragm supporting protrusions. When having formed the backplate assembly including the conductive portion and the electret material coating thereon, the process for producing a motor assembly and a transducer respectively is the same as has been described in the foregoing.

While the invention has been particularly shown and described with reference to certain preferred embodiments thereof, it will be clear that various changes in form and details may be made therein by a person skilled in the art without departing from the spirit and scope of the invention.

I claim:

1. A motor assembly for an electret transducer comprising a diaphragm plate, a composite backplate including a plate-like body constituted by substantially spherical conductive particles sintered together and a thin coating of electret material disposed on the spherical particle surfaces of said plate-like body, thereby forming an acoustically transparent backplate having substantially spherical shaped protrusions constituted by said electret material opposite to said diaphragm plate, which rests on said protrusions along a substantially flat plane substantially tangent to the contours of said protrusions, and a mounting rim supporting said composite backplate and having a peripheral portion to which the outer edge portion of said composite diaphragm is attached, said diaphragm plate having a compliant surround at its periphery.

2. A method for manufacturing a motor assembly in accordance to claim 1, comprising the steps of: forming a backplate by sintering substantially spherical, conductive particles; disposing an acoustically porous layer of electret material; bringing an electric charge into said acoustically porous layer; forming the mounting rim of an insulating material around the periphery of the formed backplate; clamping a sheet of diaphragm plate material in a support; placing the assembly including said covered backplate and mounting rim attached to the periphery thereof, onto said sheet of diaphragm plate material with said electret material opposite and in contact with said sheet, attaching said assembly along the peripheral portion of the mounting rim to the oppositely disposed portion of said sheet; and removing the unitary assembly from said support.

3. An electret transducer comprising in combination a casing and a motor assembly, said motor assembly comprising a diaphragm plate having a compliant surround at its periphery, a backplate, a plurality of apertures provided in said backplate, an electret foil disposed on said backplate, a meshlike spacing screen disposed on said electret foil opposite to said diaphragm plate, said diaphragm plate resting on said screen, the diaphragm plate supporting junctions of said screen overlying predetermined ones of said apertures, and a mounting rim supporting said backplate along the periphery thereof, the outer edge portion of said diaphragm plate being attached to the peripheral portion of said rim substantially co-planar relative to said diaphragm, said mounting rim having an external peripheral wall portion extending substantially perpendicular to the plane of said diaphragm plate said peripheral wall portion being acoustically sealed and attached to the opposite wall portion of said casing.

4. A method for manufacturing a motor assembly in accordance to claim 3, comprising the steps of: covering one backplate surface with an electret foil; bringing an electric charge into said electret foil; disposing a meshlike screen onto the electret foil surface; forming the mounting rim of an insulating material around the periphery of the backplate; clamping a sheet of diaphragm plate material in a support; placing the assembly including said covered backplate, mounting rim and meshlike screen thereon, onto said sheet of diaphragm plate material, with said screen disposed between said electret foil and said sheet; attaching said assembly along the peripheral portion of the mounting rim to the oppositely disposed portion of said sheet; and removing the unitary assembly from said support.

5. An electret transducer according to claim 3, wherein said screen junctions are provided with protrusions upon which said diaphragm plate rests.

6. An electret transducer according to claim 5, wherein the protrusions are semi-spherical on which said diaphragm plate constituting a tangent plane for said protrusions rests.

7. An electret transducer according to claim 5, wherein the protrusions are frusto-conical, the smaller head surface thereof supporting said diaphragm plate.

* * * * *